US007753094B2

(12) United States Patent
Cartwright

(10) Patent No.: US 7,753,094 B2
(45) Date of Patent: Jul. 13, 2010

(54) PETROL PUMP SAFETY NOZZLE

(76) Inventor: Lowell J. Cartwright, 4 Gainsborough Hill, Oldswindsord, Stourbridge, West Midlands D68 2DU (GB)

( * ) Notice: Subject to any disclaimer, the term of this patent is extended or adjusted under 35 U.S.C. 154(b) by 687 days.

(21) Appl. No.: 11/706,019

(22) Filed: Feb. 14, 2007

(65) Prior Publication Data

US 2008/0190515 A1 Aug. 14, 2008

(51) Int. Cl.
*B65B 1/04* (2006.01)

(52) U.S. Cl. ..... 141/292; 141/207; 141/301; 141/392

(58) Field of Classification Search ..... 141/59, 141/206, 207, 292, 301, 389, 392
See application file for complete search history.

(56) References Cited

U.S. PATENT DOCUMENTS 3,502,121 A * 3/1970 Moore et al. ..... 141/207
3,593,762 A * 7/1971 Johnson et al. ..... 141/207
4,153,085 A * 5/1979 Adams ..... 141/311 R
4,722,375 A 2/1988 Fox
5,069,260 A * 12/1991 Shea ..... 141/292
5,127,451 A * 7/1992 Fink et al. ..... 141/206
6,302,169 B1 10/2001 Pulos
6,923,226 B2 8/2005 Bartlett
6,957,674 B2 * 10/2005 Burr ..... 141/386
7,530,375 B2 * 5/2009 Aitken et al. ..... 141/371

* cited by examiner

*Primary Examiner*—Timothy L Maust
(74) *Attorney, Agent, or Firm*—Raymond M. Galasso; Galasso & Associates, LP

(57) ABSTRACT

Petrol Pump Safety Nozzle is a device for petroleum fuel pumps consisting of a retractable sleeve attached to a nozzle. The sleeve moves upward when it engages the perimeter of a petroleum gasoline receptacle. The sleeve is connected to a trigger release to allow the trigger to move and dispense gasoline. To use the preferred embodiment of Petrol Pump Safety Nozzle, a user inserts the device into a petroleum gasoline receptacle opening causing the retractable sleeve to expose the nozzle and to actuate the sliding trigger release to permit the trigger to dispense gasoline. When this device is placed inside a standard diesel fuel receptacle opening, the width of the opening will prevent engagement with the retractable sleeve and fuel cannot be pumped.

14 Claims, 1 Drawing Sheet

PETROL PUMP SAFETY NOZZLE

CROSS REFERENCE TO RELATED APPLICATIONS

This United States Non-Provisional Patent Application does not claim priority to any United States Provisional Patent applications or any foreign patent applications.

FIELD OF THE DISCLOSURE

The disclosures made herein relate generally to the oil and gas industries. The invention discussed herein is in the general classification of petroleum gasoline nozzles and dispensers.

BACKGROUND

Millions of people in the United States own cars or other motorized equipment requiring gasoline for fuel. Petroleum based gasoline and diesel fuel are two of the most common types of fuel available at most filling stations.

Typically, both types of fuel are dispensed from a nozzle connected to hoses at a pump. Petroleum gasoline is usually dispensed with a narrow nozzle and most cars and other vehicles that accept petroleum gasoline have a correspondingly small receptacle opening. In contrast, diesel pumps and vehicles usually have wider diameter nozzles and receptacle openings than their petroleum gasoline counterparts. As a result, it is possible for a petroleum gasoline nozzle to be accidentally placed inside a diesel pump receptacle opening. When this occurs serious damage can occur to the diesel engine.

Hence, there is a need in the art for an inexpensive, durable, easy to use and install device that prevents petroleum fuel from being pumped into a diesel fuel tank.

SUMMARY OF THE DISCLOSURE

Petrol Pump Safety Nozzle is a device for petroleum fuel pumps having a retractable sleeve attached to the nozzle. The sleeve moves upward when it engages the perimeter of a petroleum gasoline receptacle. The sleeve is operatively connected to a trigger release that allows the trigger to move and dispense gasoline.

The principal object of this invention is to provide a device that prevents accidental dispensing of petroleum gasoline into a diesel fuel tank.

Another object of this invention is to provide an affordable device that prevents accidental dispensing of petroleum gasoline into a diesel fuel tank.

Another object of this invention is to provide a device that is easily installed and prevents accidental dispensing of petroleum gasoline into a diesel fuel tank.

Another object of this invention is to provide a safe device that prevents accidental dispensing of petroleum gasoline into a diesel fuel tank.

Another object of this invention is to provide a device that can either be newly manufactured with gasoline pumps or that can be retrofitted and used on existing gasoline pumps to prevent accidental dispensing of petroleum gasoline into a diesel fuel tank.

Yet another object of this invention is to provide a durable device that prevents accidental dispensing of petroleum gasoline into a diesel fuel tank.

DETAILED DESCRIPTION OF THE DRAWINGS

Figure 1:
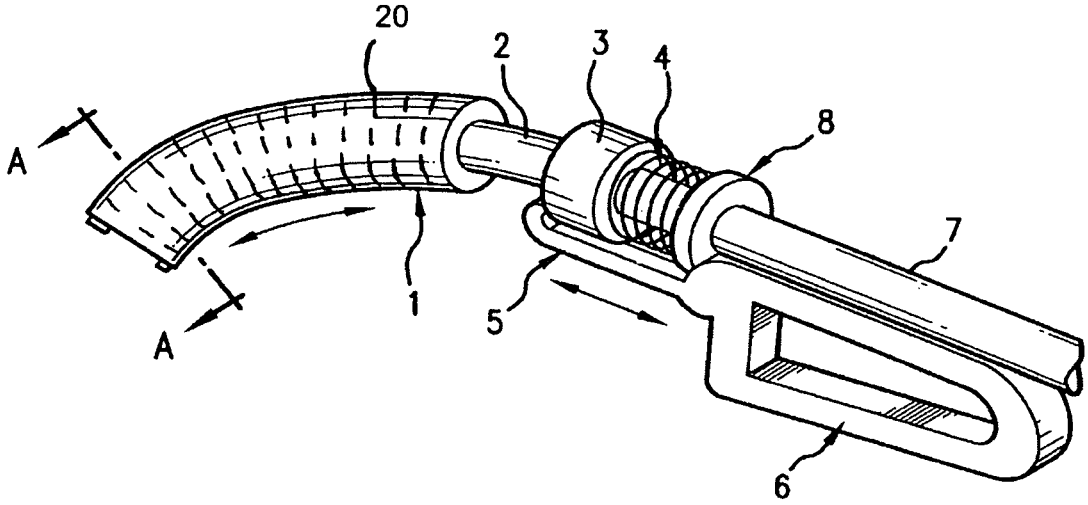
FIG. 1 depicts a preferred embodiment of the present invention.

The preferred embodiment of Petrol Pump Safety Nozzle is comprised of at least some of the following: a nozzle, a stop ring, a retractable sleeve, a second sleeve, non-ferrous compression springs, a sliding trigger release and a trigger In the preferred embodiment of the invention, shown in FIG. 1, a retractable sleeve 1 covers a nozzle 2. In this embodiment, the retractable sleeve 1 extends over the tip of the nozzle. Other embodiments need not have the retractable sleeve extending over the tip of the nozzle. The retractable sleeve 1 is located on non-ferrous compression springs (not pictured) to eliminate the danger of sparks. The compression springs are also preferably non-ferrous to prevent rust though other materials may also be utilized. In certain other embodiments, a spring or other similar device could operate as the retractable sleeve. In this embodiment, the non-ferrous compression springs permit the retractable sleeve 1 to move upward on the nozzle 2 approximately two inches. The retractable sleeve 1 is capable of contacting a second sleeve 3 attached to non-ferrous compression springs 4 connected to a stop ring 8 on one end of the nozzle 2. The second sleeve 3 is also connected to a sliding trigger release 5 that moves when the second sleeve 3 moves upward compressing the non-ferrous compression springs 4. The sliding trigger release 5 unlocks the trigger 6 as it moves and permits fuel to be dispensed from the pump (not pictured) through the hose 7 and into the nozzle 2 connected to the hose 7. Conversely, release of the trigger 6 causes the second sleeve 3 to reengage, locking the trigger 6 again.

The nozzle 2 has the standard diameter used at petroleum gasoline pumps. The retractable sleeve 1 has an outer diameter large enough to permit it to engage the perimeter of standard petroleum gasoline receptacle openings but small enough to not engage the perimeter of standard diesel fuel receptacle openings. The nozzle 2 and retractable sleeve 1 are cylindrical but slightly curved. The second sleeve 3 is cylindrical in shape in the preferred embodiment though other shapes may also be utilized.

Ideally, the retractable sleeve 1, second sleeve 3, trigger 6 and sliding trigger release 5 are made of plastic although other materials may also be utilized. The nozzle 2 and stop ring 8 are ideally made of metal though other materials may also be utilized.

Figure 2:
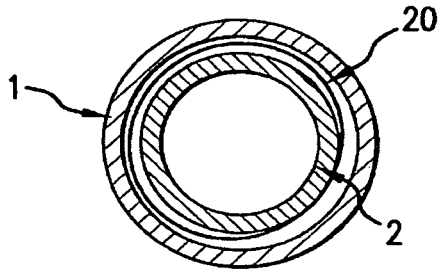
FIG. 2 depicts a cross-sectional view of the preferred embodiment of the invention cut along the line A-A of FIG. 1.

FIG. 2 depicts a cross-sectional view of the preferred embodiment of the invention cut along the line A-A of FIG. 1. The retractable sleeve 1 is located on top of non-ferrous compression springs 20 that are on top of the nozzle 2.

To use the preferred embodiment of Petrol Pump Safety Nozzle, a user inserts the device into a petroleum gasoline receptacle opening causing the retractable sleeve to expose the nozzle and push against the second sleeve. This motion actuates the sliding trigger release to permit the trigger to dispense gasoline. When this device is placed inside a standard diesel fuel receptacle opening, the width of the opening will prevent engagement with the retractable sleeve and fuel cannot be pumped with the trigger.

The components of Petrol Pump Safety Nozzle may vary but will likely use metal and plastic materials. The metals would ideally be selected from available steel or alloys of steel and aluminum. The production process related to the use of these metals insures that the metal is non-corrosive, durable and strong. The selected metal should have high impact strength and be capable of accepting and retaining coloring materials for an extended length of time.

The plastic used in the production will ideally be selected for durability and longevity. Thermoplastics are commonly used in the manufacturing of components similar to those used in this invention. Polyethylene, polypropylene, and other similar thermoplastic materials would be among those with the necessary traits. Members of this family are recognized universally as being versatile and of high quality.

The plastic components of Petrol Pump Safety Nozzle can also be formed with the use of plastic molding techniques, such as injection molding or blow molding. Injection molding requires melted plastic to be forcefully injected into relatively cool molds. As the plastic begins to harden, it takes on the shape of the mold cavity. This technique is ideal for the mass production of products. Alternatively, blow molding, a form of extrusion, could be utilized. Blow molding involves a molten tube being pushed into a mold. Compressed air then forces the molten tube against the cold walls of the mold.

It should be obvious that the components of the present invention can be of various shapes and sizes. It should also be obvious that the components of the invention can be made of different types of metals, plastics or other suitable materials and can be of any color. It should further be obvious that in certain embodiments a single retractable sleeve or set of compression springs dimensioned to engage a petroleum gasoline receptacle opening could be utilized to engage the trigger release and allow gasoline to be pumped with the trigger.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. A gasoline filling accessory device comprising:

(a) a nozzle of a standard diameter used at petroleum gasoline pumps;

(b) retractable sleeve capable of covering at least a portion of the nozzle;

(c) a second sleeve connected to a retractable mechanism and contactable by the retractable sleeve; wherein said sleeve has an outer diameter large enough to permit it to engage the perimeter of a standard petroleum gasoline receptacle but small enough not to engage the perimeter of standard diesel fuel receptacle openings;

(d) a sliding trigger release operatively connected to the second sleeve; wherein said trigger release unlocks a trigger as it moves and permits fuel to be dispensed from the pump;

(e) a trigger operable to dispense fuel; and (f) a stop ring; wherein said stop ring causes the movement of the retractable sleeve and the second sleeve to cease.

2. The device of claim 1 wherein the retractable sleeve, the second sleeve, the trigger release and the trigger are made of plastic.

3. The device of claim 1 wherein the nozzle is made of metal.

4. The device of claim 1 wherein the retractable sleeve moves approximately two inches upward on the nozzle.

5. The device of claim 1 wherein the retractable sleeve and the nozzle are approximately cylindrical and curved.

6. The device of claim 1 wherein the retractable sleeve is located on a first compression spring that is on top of the nozzle.

7. The device of claim 6 wherein the first compression spring on top of the nozzle is non-ferrous.

8. The device of claim 1 wherein the retractable mechanism is a second compression spring.

9. The device of claim 8 wherein the second compression spring is non-ferrous.

10. The device of claim 8 wherein the second compression spring connects to a stop ring located on the nozzle opposite the retractable sleeve.

11. The device of claim 10 wherein the stop ring is made of metal.

12. The device of claim 1 wherein the trigger release is slidable.

13. The device of claim 1 wherein the second sleeve is cylindrical.

14. A gasoline filling accessory device comprising:

(a) a nozzle; wherein the nozzle is made of metal and is cylindrical and curved;

(b) a retractable sleeve located on top of a first compression spring covering the nozzle and made of a non-ferrous material; wherein the retractable sleeve is made of plastic and is cylindrical and curved and capable of moving two inches on the first compression spring; said retractable sleeve having a diameter large enough to engage the perimeter of a standard petroleum gasoline receptacle opening but small enough not to engage the perimeter of a standard diesel fuel receptacle opening;

(c) a second sleeve that is cylindrical and plastic connected to a second compression spring made of a non-ferrous material and contactable by the retractable sleeve;

(d) a trigger for dispensing fuel;

(e) a slidable trigger release made of plastic and connected to the second sleeve and to the trigger made of plastic; wherein the sliding trigger release slides it operates the trigger as it moves when the retractable sleeve contacts the second sleeve causing it to move; and (f) the second compression spring connected to a stop ring made of metal that is located on the nozzle opposite the retractable sleeve.

* * * * *